US011763743B2

(12) United States Patent
Chen et al.

(10) Patent No.: US 11,763,743 B2
(45) Date of Patent: Sep. 19, 2023

(54) PIXEL CIRCUIT AND DRIVING METHOD THEREOF, AND DISPLAY DEVICE

(71) Applicant: BOE Technology Group Co., Ltd., Beijing (CN)

(72) Inventors: Liang Chen, Beijing (CN); Dongni Liu, Beijing (CN); Li Xiao, Beijing (CN); Minghua Xuan, Beijing (CN); Haoliang Zheng, Beijing (CN); Zhenyu Zhang, Beijing (CN); Hao Chen, Beijing (CN); Jiao Zhao, Beijing (CN); Qi Qi, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 107 days.

(21) Appl. No.: 17/424,176

(22) PCT Filed: Jan. 13, 2021

(86) PCT No.: PCT/CN2021/071512
§ 371 (c)(1),
(2) Date: Jul. 20, 2021

(87) PCT Pub. No.: WO2021/175017
PCT Pub. Date: Sep. 10, 2021

(65) Prior Publication Data

US 2022/0310011 A1 Sep. 29, 2022

(30) Foreign Application Priority Data

Mar. 4, 2020 (CN) ..... 202010142866.1

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2300/0426* (2013.01);
(Continued)

(58) Field of Classification Search
CPC ..... G09G 3/3233; G09G 3/2007; G09G 2300/0426; G09G 2300/0819;
(Continued)

(56) References Cited

U.S. PATENT DOCUMENTS

2005/0253797 A1 11/2005 Kamada et al.
2014/0022150 A1 1/2014 Guo et al.
(Continued)

FOREIGN PATENT DOCUMENTS

CN 1694152 A 11/2005
CN 103000132 A 3/2013
(Continued)

OTHER PUBLICATIONS

International Search Report for PCT/2021/071512 dated Apr. 21, 2021.
(Continued)

*Primary Examiner* — Kenneth B Lee, Jr.
(74) *Attorney, Agent, or Firm* — Ling Wu; Stephen Yang; Ling and Yang Intellectual Property

(57) ABSTRACT

A pixel circuit includes a current control sub-circuit, a combined light emitting sub-circuit, and a first light emitting element to an Nth light emitting element, N being a natural number greater than 1. The current control sub-circuit is configured to receive a display data signal and a light emitting control signal, control whether to generate a driving current according to the light emitting control signal, and control a current intensity of the generated driving current according to the display data signal. The combined light emitting sub-circuit is configured to receive the driving
(Continued)

current and a first light emitting data signal to an Nth light emitting data signal and drive one or more of the first light emitting element to the Nth light emitting element to emit light according to the first light emitting data signal to the Nth light emitting data signal.

18 Claims, 8 Drawing Sheets

(52) U.S. Cl.
CPC ..... *G09G 2300/0819* (2013.01); *G09G 2300/0842* (2013.01); *G09G 2310/08* (2013.01); *G09G 2320/0242* (2013.01); *G09G 2320/0247* (2013.01)

(58) Field of Classification Search
CPC ..... G09G 2300/0842; G09G 2310/08; G09G 2320/0242; G09G 2320/0247
See application file for complete search history.

(56) References Cited

U.S. PATENT DOCUMENTS

| | | | |
|---|---|---|---|
| 2015/0356919 | A1 | 12/2015 | Wang et al. |
| 2017/0039934 | A1* | 2/2017 | Ma ..... G09G 3/3233 |
| 2019/0108790 | A1 | 4/2019 | Liang et al. |
| 2020/0243003 | A1 | 7/2020 | Yang et al. |
| 2020/0402463 | A1 | 12/2020 | Wang |
| 2021/0217352 | A1 | 7/2021 | Xuan et al. |
| 2021/0295774 | A1 | 9/2021 | Sun et al. |

FOREIGN PATENT DOCUMENTS

| | | | |
|---|---|---|---|
| CN | 104050916 | A | 9/2014 |
| CN | 104732926 | A | 6/2015 |
| CN | 107342047 | A | 11/2017 |
| CN | 107644948 | A | 1/2018 |
| CN | 108364607 | A | 8/2018 |
| CN | 110226195 | A | 9/2019 |
| CN | 110246459 | A | 9/2019 |
| CN | 110264956 | A | 9/2019 |
| CN | 111312158 | A | 6/2020 |

OTHER PUBLICATIONS

Office Action dated Nov. 18, 2020 for Chinese Patent Application No. 202010142866.1 and English Translation.
Office Action dated May 18, 2021 for Chinese Patent Application No. 202010142866.1 and English Translation.

* cited by examiner

PIXEL CIRCUIT AND DRIVING METHOD THEREOF, AND DISPLAY DEVICE

CROSS-REFERENCE TO RELATED APPLICATIONS

The present application is a U.S. National Phase Entry of International Application No. PCT/CN2021/071512 having an international filing date of Jan. 13, 2021, which claims priority to Chinese patent application No. 2020101428661, filed to the CNIPA on Mar. 4, 2020 and entitled "Pixel Circuit and Driving Method Thereof, and Display Device". The entire contents of the above-identified applications are hereby incorporated by reference.

TECHNICAL FIELD

Embodiments of the present disclosure relate, but not limited, to the technical field of display, and particularly to a pixel circuit, a driving method thereof, and a display device.

BACKGROUND

A Micro Light Emitting Diode (LED) technology achieves thin-film, micro, and matrix design of LEDs by highly dense integration of micro-sized LED arrays to a chip, a distance between pixels may reach a micron level, and each pixel may implement independent fixed-point light emission. Micro LED display panels are gradually developed towards display panels used for consumer terminals due to the characteristics of low driving voltage, long service life, resistance to wide temperatures, etc.

A pixel circuit is usually electrically connected with a Micro LED to drive the Micro LED to emit light. In the related pixel circuit, a grayscale is usually adjusted through both a current and light emitting time. However, when the grayscale is adjusted through the current, a low grayscale may correspond to a low current density, the efficiency may be reduced, and with changing of a current density, a color coordinate of the Micro LED may change, namely the Micro LED may have a color shift when the grayscale changes. When the grayscale is adjusted by reducing the light emitting time, a picture may flicker easily, and a display effect of a display panel may further be affected.

SUMMARY

The below is a summary of the subject described herein in detail. The summary is not intended to limit the scope of protection of the claims.

The embodiments of the present disclosure provide a pixel circuit, which includes a current control sub-circuit, a combined light emitting sub-circuit, and a first light emitting element to an Nth light emitting element, N being a natural number greater than 1. Herein, the current control sub-circuit is configured to receive a display data signal and a light emitting control signal, control whether to generate a driving current according to the light emitting control signal, and control a current intensity of the generated driving current according to the display data signal. The combined light emitting sub-circuit is configured to receive the driving current and a first light emitting data signal to an Nth light emitting data signal and drive one or more of the first light emitting element to the Nth light emitting element to emit light according to the received driving current and first light emitting data signal to Nth light emitting data signal.

In some exemplary embodiments, the combined light emitting sub-circuit includes a first light emitting sub-circuit and a second light emitting sub-circuit, and the driving current is divided into a first driving current configured to drive the first light emitting element and a second driving current configured to drive a second light emitting element. Herein, the first light emitting sub-circuit is connected with a reset control signal terminal, a first light emitting data signal terminal, and the first light emitting element respectively, and is configured to receive the first driving current, and under the control of the reset control signal terminal and the first light emitting data signal terminal, drive the first light emitting element to emit light or control the first light emitting element not to emit light. The second light emitting sub-circuit is connected with a first scanning signal terminal, a second light emitting data signal terminal, and the second light emitting element respectively, and is configured to receive the second driving current, and under the control of the first scanning signal terminal and the second light emitting data signal terminal, drive the second light emitting element to emit light or control the second light emitting element not to emit light.

In some exemplary embodiments, the first light emitting sub-circuit includes a first transistor, a second transistor, and a first capacitor, and the second light emitting sub-circuit includes a third transistor, a fourth transistor, and a second capacitor. Herein, a control electrode of the first transistor is connected with a second node, a first electrode of the first transistor is connected with a first node, and a second electrode of the first transistor is connected with the first light emitting element. A control electrode of the second transistor is connected with the reset control signal terminal, a first electrode of the second transistor is connected with the first light emitting data signal terminal, and a second electrode of the second transistor is connected with the second node. One terminal of the first capacitor is connected with the second node, and the other terminal of the first capacitor is connected with a common voltage terminal. A control electrode of the third transistor is connected with a third node, a first electrode of the third transistor is connected with the first node, and a second electrode of the third transistor is connected with the second light emitting element. A control electrode of the fourth transistor is connected with the first scanning signal terminal, a first electrode of the fourth transistor is connected with the second light emitting data signal terminal, and a second electrode of the fourth transistor is connected with the third node. One terminal of the second capacitor is connected with the third node, and the other terminal of the second capacitor is connected with the common voltage terminal.

In some exemplary embodiments, the current control sub-circuit is further configured to control a duration of the generated driving current according to the light emitting control signal. The combined light emitting sub-circuit is further configured to control light emitting durations of the first light emitting element to the Nth light emitting element according to the duration of the generated driving current.

In some exemplary embodiments, the combined light emitting sub-circuit includes a third light emitting sub-circuit and a fourth light emitting sub-circuit, and the driving current is divided into the first driving current configured to drive the first light emitting element and the second driving current configured to drive the second light emitting element. Herein, the third light emitting sub-circuit is connected with a second scanning signal terminal, the first light emitting data signal terminal, and the first light emitting element respectively, and is configured to receive the first driving current, and under the control of the second scanning signal terminal and the first light emitting data signal terminal, drive the first light emitting element to emit light and control a light emitting duration of the first light emitting element according to a duration of the first driving current, or control the first light emitting element not to emit light. The fourth light emitting sub-circuit is connected with a third scanning signal terminal, the second light emitting data signal terminal, and the second light emitting element respectively, and is configured to receive the second driving current, and under the control of the third scanning signal terminal and the second light emitting data signal terminal, drive the second light emitting element to emit light and control a light emitting duration of the second light emitting element according to a duration of the second driving current, or control the second light emitting element not to emit light.

In some exemplary embodiments, the third light emitting sub-circuit includes the first transistor, a fifth transistor, and the first capacitor, and the fourth light emitting sub-circuit includes the third transistor, a sixth transistor, and the second capacitor. Herein, the control electrode of the first transistor is connected with the second node, the first electrode of the first transistor is connected with the first node, and the second electrode of the first transistor is connected with the first light emitting element. A control electrode of the fifth transistor is connected with the second scanning signal terminal, a first electrode of the fifth transistor is connected with the first light emitting data signal terminal, and a second electrode of the fifth transistor is connected with the second node. One terminal of the first capacitor is connected with the second node, and the other terminal of the first capacitor is connected with the common voltage terminal. The control electrode of the third transistor is connected with the third node, the first electrode of the third transistor is connected with the first node, and the second electrode of the third transistor is connected with the second light emitting element. A control electrode of the sixth transistor is connected with the third scanning signal terminal, a first electrode of the sixth transistor is connected with the second light emitting data signal terminal, and a second electrode of the sixth transistor is connected with the third node. One terminal of the second capacitor is connected with the third node, and the other terminal of the second capacitor is connected with the common voltage terminal.

In some exemplary embodiments, the current control sub-circuit includes a driving sub-circuit, a write sub-circuit, a compensation sub-circuit, a reset sub-circuit, and a light emitting control sub-circuit. Herein, the driving sub-circuit is connected with a fourth node, a fifth node, and a sixth node respectively, and is configured to provide the driving current for the sixth node under the control of signals of the fourth node and the fifth node. The write sub-circuit is connected with the first scanning signal terminal, the display data signal terminal, and the fifth node respectively, and is configured to write a signal of the display data signal terminal to the fifth node under the control of a signal of the first scanning signal terminal. The compensation sub-circuit is connected with a first voltage terminal, the first scanning signal terminal, the fourth node, and the sixth node respectively, and is configured to compensate the fourth node under the control of the signal of the first scanning signal terminal and a signal of the first voltage terminal. The reset sub-circuit is connected with the reset control signal terminal, an initial voltage terminal, and the fourth node respectively, and is configured to write a signal of the initial voltage terminal to the fourth node under the control of a signal of the reset control signal terminal. The light emitting control sub-circuit is connected with the first voltage terminal, the light emitting control signal terminal, the first node, the fifth node, and the sixth node respectively, and is configured to provide the signal of the first voltage terminal for the fifth node under the control of a signal of the light emitting control signal terminal, and allow the driving current to flow between the sixth node and the first node.

In some exemplary embodiments, the driving sub-circuit includes a seventh transistor, the compensation sub-circuit includes an eighth transistor and a third capacitor, the reset sub-circuit includes a ninth transistor, the write sub-circuit includes a tenth transistor, and the light emitting control sub-circuit includes an eleventh transistor and a twelfth transistor. Herein, a control electrode of the seventh transistor is connected with the fourth node, a first electrode of the seventh transistor is connected with the fifth node, and a second electrode of the seventh transistor is connected with the sixth node. A control electrode of the eight transistor is connected with the first scanning signal terminal, a first electrode of the eighth transistor is connected with the fourth node, and a second electrode of the eighth transistor is connected with the sixth node. One terminal of the third capacitor is connected with the fourth node, and the other terminal of the third capacitor is connected with the first voltage terminal. A control electrode of the ninth transistor is connected with the reset control signal terminal, a first electrode of the ninth transistor is connected with the initial voltage terminal, and a second electrode of the ninth transistor is connected with the fourth node. A control electrode of the tenth transistor is connected with the first scanning signal terminal, a first electrode of the tenth transistor is connected with the display data signal terminal, and a second electrode of the tenth transistor is connected with the fifth node. A control electrode of the eleventh transistor is connected with the light emitting control signal terminal, a first electrode of the eleventh transistor is connected with the first voltage terminal, and a second electrode of the eleventh transistor is connected with the fifth node. A control electrode of the twelfth transistor is connected with the light emitting control signal terminal, a first electrode of the twelfth transistor is connected with the sixth node, and a second electrode of the twelfth transistor is connected with the first node.

The embodiments of the present disclosure also provide a display device, which includes any abovementioned pixel circuit.

The embodiments of the present disclosure also provide a driving method for a pixel circuit, which is used to drive the abovementioned pixel circuit. The pixel circuit has multiple scanning periods. In a scanning period, the driving method includes that: a current control sub-circuit receives a display data signal and a light emitting control signal, controls whether to generate a driving current according to the light emitting control signal, and controls a current intensity of the generated driving current according to the display data signal; and a combined light emitting sub-circuit receives the driving current and a first light emitting data signal to an Nth light emitting data signal and drives one or more of a first light emitting element to an Nth light emitting element to emit light according to the received driving current and first light emitting data signal to Nth light emitting data signal.

In some exemplary embodiments, the driving method further includes that: current control sub-circuit controls a duration of the generated driving current according to the light emitting control signal; and the combined light emitting sub-circuit controls light emitting durations of the first light emitting element to the Nth light emitting element according to the duration of the generated driving current.

After the description of the drawings and implementation modes of the present disclosure are read and understood, other aspects can be understood.

BRIEF DESCRIPTION OF DRAWINGS

The drawings provide an understanding to the technical solution of the present disclosure, form a part of the specification and are adopted to explain, together with the embodiments of the present disclosure, the technical solutions of the present disclosure and not intended to form limits to the technical solutions of the present disclosure.

DETAILED DESCRIPTION

In order to make the purposes, technical solutions, and advantages of the present disclosure clearer, the embodiments of the present disclosure will be described below in combination with the drawings in detail. The embodiments in the present disclosure and the features in the embodiments can be freely combined without conflicts.

Unless otherwise defined, technical terms or scientific terms used in the embodiments of the present disclosure should have the same meanings as commonly understood by those of ordinary skill in the art that the present disclosure belongs to. "First", "second", and similar terms used in the embodiments of the present disclosure do not represent any sequence, number, or significance but are only adopted to distinguish different components. "Include", "contain", or a similar term means that an element or object appearing before the term covers an element or object and equivalent thereof listed after the term and does not exclude other elements or objects.

Those skilled in the art can understand that transistor adopted in all the embodiments of the present disclosure may be a thin-film transistor, or a field-effect transistor, or another device with the same characteristic. In some exemplary embodiments, the thin-film transistor used in the embodiments of the present disclosure may be an oxide semiconductor transistor. A source and drain of the transistor used here are symmetric, so the drain and the source may be interchanged. In the embodiments of the present disclosure, for distinguishing the two electrodes, except the gate, of the transistor, one electrode is called a first electrode, the other electrode is called a second electrode, the first electrode may be the source or the drain, and the second electrode may be the drain or the source.

Figure 1:
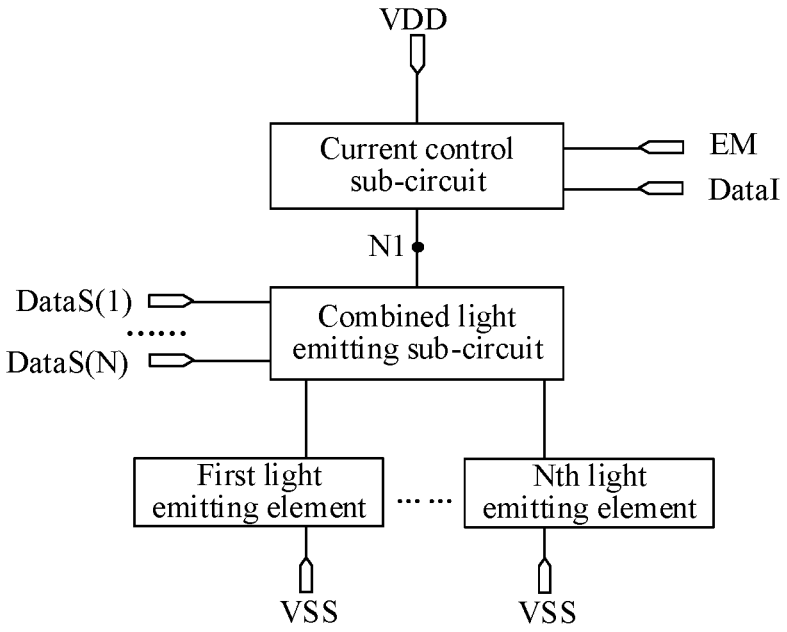
FIG. 1 is a first structural schematic diagram of a pixel circuit according to an embodiment of the present disclosure.

An embodiment of the present disclosure provides a pixel circuit. FIG. 1 is a structural schematic diagram of a pixel circuit according to an embodiment of the present disclosure. As shown in FIG. 1, the pixel circuit provided in the embodiment of the present disclosure includes a current control sub-circuit, a combined light emitting sub-circuit, and a first light emitting element EL1 to an Nth light emitting element ELN. Herein, N is a natural number greater than 1.

Herein, the current control sub-circuit is connected with a first voltage terminal VDD, a display data signal terminal DataI, a light emitting control signal terminal EM, and a first node N1 respectively, and is configured to receive a display data signal of the display data signal terminal DataI and a light emitting control signal of the light emitting control signal terminal EM, control whether to generate a driving current according to the light emitting control signal, and control a current intensity of the generated driving current according to the display data signal.

The combined light emitting sub-circuit is connected with the first node N1, a first light emitting data signal terminal DataS(1) to an Nth light emitting data signal terminal DataS(N), and the first light emitting element EL1 to the Nth light emitting element ELN respectively, and is configured to receive the driving current of the current control sub-circuit and a first light emitting data signal of the first light emitting data signal terminal DataS(1) to an Nth light emitting data signal of the Nth light emitting data signal terminal DataS(N), and drive one or more of the first light emitting element EL1 to the Nth light emitting element ELN to emit light according to the received driving current and first light emitting data signal to Nth light emitting data signal.

In the present embodiment, the first light emitting data signal may be configured to control the first light emitting element EL1 whether to emit light, a second light emitting data signal may be configured to control a second light emitting element EL2 whether to emit light, . . . , and the Nth light emitting data signal may be configured to control the Nth light emitting element ELN whether to emit light. For example, when an ith light emitting data signal is a low level, an ith light emitting element ELi emits light, i being a natural number from 1 to N.

According to the pixel circuit provided in the embodiment of the present disclosure, the combined light emitting sub-circuit drives one or more of the first light emitting element EL1 to the Nth light emitting element ELN to emit light according to the received driving current and first light emitting data signal to Nth light emitting data signal to implement combined light emitting of light emitting element chips with different areas, so that display effects of a display device under high and low grayscales are improved.

The pixel circuit of the embodiment of the present disclosure may be implemented through multiple solutions. The technical solutions of the embodiment of the present disclosure will be described below in detail with multiple embodiments.

Descriptions are made in the embodiment of the present disclosure taking N=2 as an example, namely the pixel circuit includes two light emitting elements. Light emitting areas of the two light emitting elements may be the same, or may be different. Exemplarily, the light emitting area of the first light emitting element EL1 may be smaller than the light emitting area of the second light emitting element EL2, to achieve a combined light emitting effect of different areas. The structure of the pixel circuit provided in the present embodiment is also applied to the condition that N is another value. When N is 3 or greater than 3, light emitting sub-circuits where M light emitting elements in the N light emitting elements are located may be selected to be connected with a reset control signal terminal Reset, and light emitting sub-circuits where the (N−M) light emitting elements in the N light emitting elements are connected with a first scanning signal terminal GateA, M being a natural number from 1 to N−1.

Figure 2:
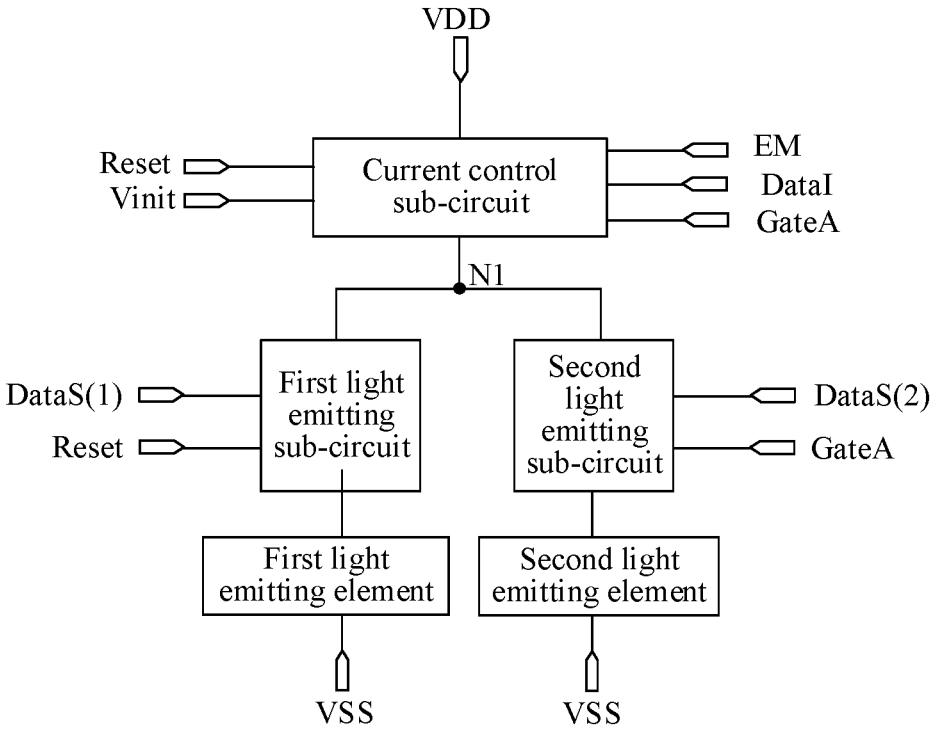
FIG. 2 is a second structural schematic diagram of a pixel circuit according to an embodiment of the present disclosure.

FIG. 2 is a structural schematic diagram of a pixel circuit according to an embodiment of the present disclosure. As shown in FIG. 2, the combined light emitting sub-circuit includes a first light emitting sub-circuit and a second light emitting sub-circuit, and the driving current is divided into a first driving current configured to drive the first light emitting element EL1 and a second driving current configured to drive the second light emitting element EL2.

Herein, the first light emitting sub-circuit is connected with the first node N1, the reset control signal terminal Reset, the first light emitting data signal terminal DataS(1), and the first light emitting element EL1 respectively, and is configured to receive the first driving current, and under the control of a reset signal of the reset control signal terminal Reset and the first light emitting data signal of the first light emitting data signal terminal DataS(1), drive the first light emitting element EL1 to emit light or control the first light emitting element EL1 not to emit light.

The second light emitting sub-circuit is connected with the first node N1, the first scanning signal terminal GateA, the second light emitting data signal terminal DataS(2), and the second light emitting element EL2 respectively, and is configured to receive the second driving current, and under the control of a first scanning signal of the first scanning signal terminal GateA and the second light emitting data signal of the second light emitting data signal terminal DataS(2), drive the second light emitting element EL2 to emit light or control the second light emitting element EL2 not to emit light.

In some exemplary embodiments, when only one of the first light emitting element EL1 and the second light emitting element EL2 emits light, the driving current of the sub-circuit corresponding to the light emitting element that does not emit light is zero. For example, when the first light emitting element EL1 emits light, and the second light emitting element EL2 does not emit light, a current value of the second driving current is zero, and a current value of the first driving current is equal to a current value of the driving current.

Figure 3:
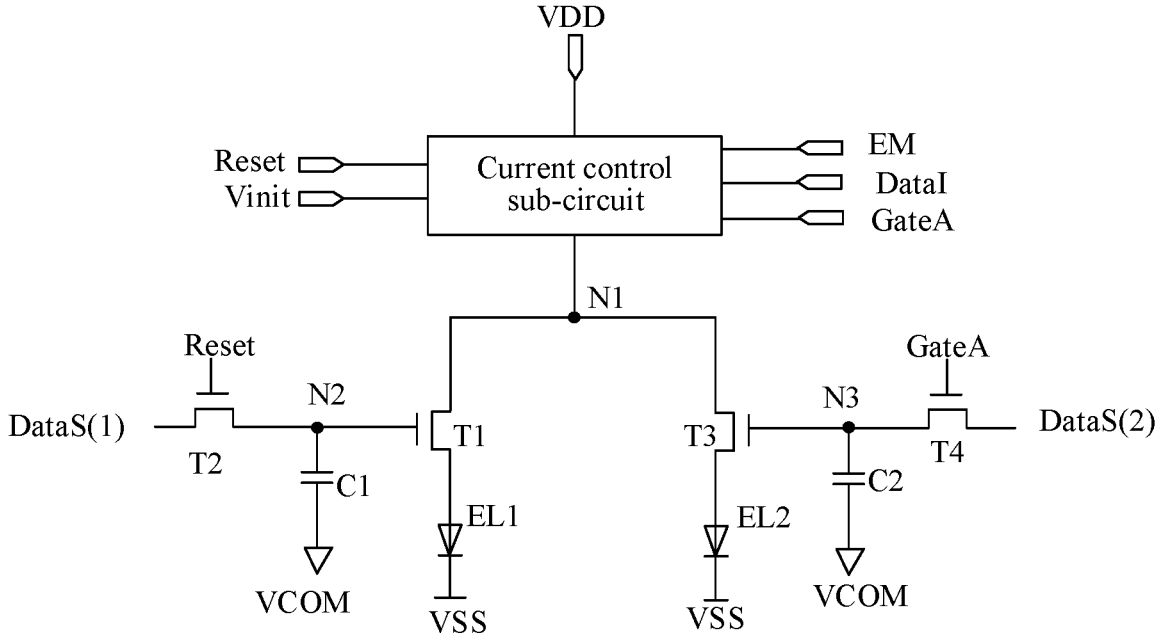
FIG. 3 is a first equivalent circuit diagram of a combined light emitting sub-circuit according to an embodiment of the present disclosure.

In some exemplary embodiments, as shown in FIG. 3, the first light emitting sub-circuit provided in the embodiment of the present disclosure includes a first transistor T1, a second transistor T2, and a first capacitor C1, and the second light emitting sub-circuit includes a third transistor T3, a fourth transistor T4, and a second capacitor C2.

Herein, a control electrode of the first transistor T1 is connected with a second node N2, a first electrode of the first transistor T1 is connected with the first node N1, a second electrode of the first transistor T1 is connected with an anode of the first light emitting element EL1, and a cathode of the first light emitting element EL1 is connected with a second voltage terminal VSS. A control electrode of the second transistor T2 is connected with the reset control signal terminal Reset, a first electrode of the second transistor T2 is connected with the first light emitting data signal terminal DataS(1), and a second electrode of the second transistor T2 is connected with the second node N2. One terminal of the first capacitor C1 is connected with the second node N2, and the other terminal of the first capacitor C1 is connected with a common voltage terminal VCOM. A control electrode of the third transistor T3 is connected with a third node N3, a first electrode of the third transistor T3 is connected with the first node N1, a second electrode of the third transistor T3 is connected with an anode of the second light emitting element EL2, and a cathode of the second light emitting element EL2 is connected with the second voltage terminal VSS. A control electrode of the fourth transistor T4 is connected with the first scanning signal terminal GateA, a first electrode of the fourth transistor T4 is connected with the second light emitting data signal terminal DataS(2), and a second electrode of the fourth transistor T4 is connected with the third node N3. One terminal of the second capacitor C2 is connected with the third node N3, and the other terminal of the second capacitor C2 is connected with the common voltage terminal VCOM.

FIG. 3 shows exemplary structures of the first light emitting sub-circuit and the second light emitting sub-circuit. Those skilled in the art easily understand that implementation modes of the first light emitting sub-circuit and the second light emitting sub-circuit are not limited thereto as long as functions thereof may be realized.

Figure 4:
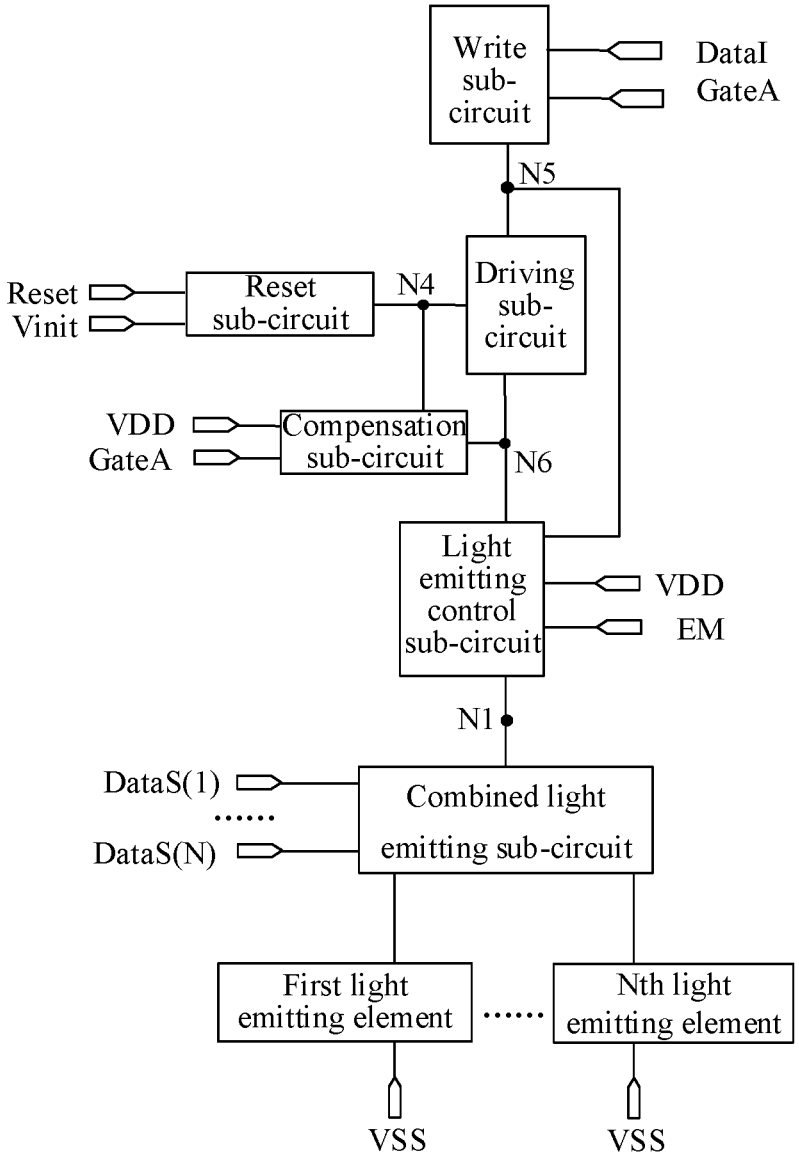
FIG. 4 is a structural schematic diagram of a current control sub-circuit according to an embodiment of the present disclosure.

In some exemplary embodiments, as shown in FIG. 4, the current control sub-circuit provided in the embodiment of the present disclosure includes a driving sub-circuit, a write sub-circuit, a compensation sub-circuit, a reset sub-circuit, and a light emitting control sub-circuit.

Herein, the driving sub-circuit is connected with a fourth node N4, a fifth node N5, and a sixth node N6 respectively, and is configured to provide the driving current for the sixth node N6 under the control of signals of the fourth node N4 and the fifth node N5. The write sub-circuit is connected with the first scanning signal terminal GateA, the display data signal terminal DataI, and the fifth node N5 respectively, and is configured to write the display data signal of the display data signal terminal DataI to the fifth node N5 under the control of the first scanning signal of the first scanning signal terminal GateA. The compensation sub-circuit is connected with the first voltage terminal VDD, the first scanning signal terminal GateA, the fourth node N4, and the sixth node N6 respectively, and is configured to compensate the fourth node N4 under the control of the first scanning signal of the first scanning signal terminal GateA and a first voltage signal of the first voltage terminal VDD. The reset sub-circuit is connected with the reset control signal terminal Reset, an initial voltage terminal Vinit, and the fourth node N4 respectively, and is configured to write an initial voltage signal of the initial voltage terminal Vinit to the fourth node N4 under the control of the reset control signal of the reset control signal terminal Reset. The light emitting control sub-circuit is connected with the first voltage terminal VDD, the light emitting control signal terminal EM, the first node N1, the fifth node N5, and the sixth node N6 respectively, and is configured to provide the first voltage signal of the first voltage terminal VDD for the fifth node N5 under the control of the light emitting control signal of the light emitting control signal terminal EM, and allow the driving current to flow between the sixth node N6 and the first node N1.

Figure 5:
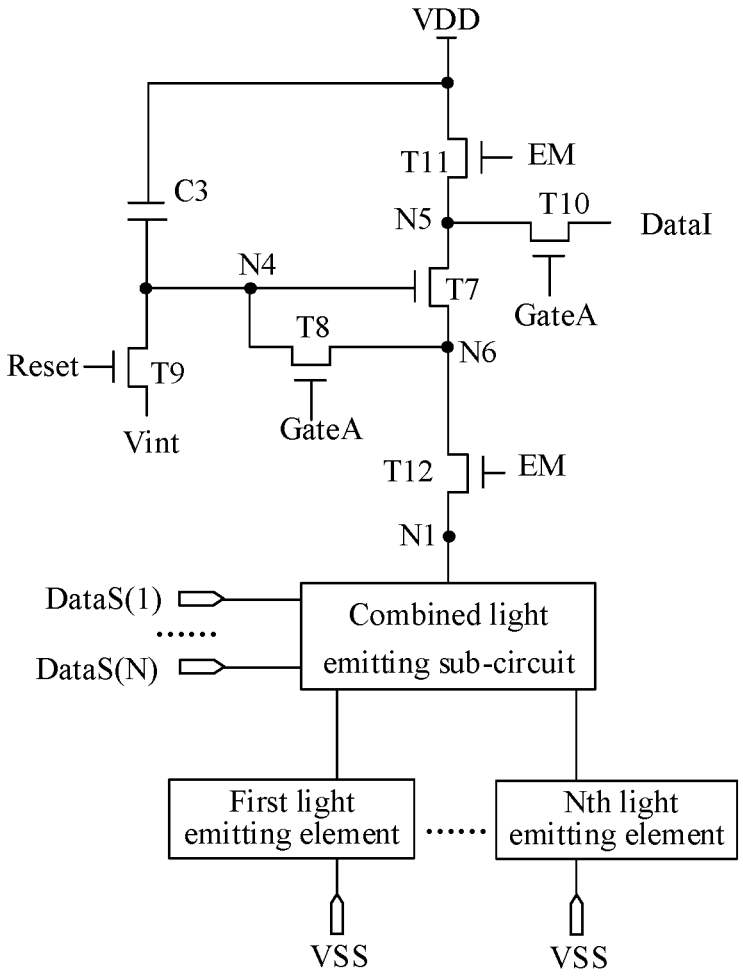
FIG. 5 is an equivalent circuit diagram of a current control sub-circuit according to an embodiment of the present disclosure.

In some exemplary embodiments, as shown in FIG. 5, the driving sub-circuit includes a seventh transistor T7, the compensation sub-circuit includes an eighth transistor T8 and a third capacitor C3, the reset sub-circuit includes a ninth transistor T9, the write sub-circuit includes a tenth transistor T10, and the light emitting control sub-circuit includes an eleventh transistor T11 and a twelfth transistor T12.

Herein, a control electrode of the seventh transistor T7 is connected with the fourth node N4, a first electrode of the seventh transistor T7 is connected with the fifth node N5, and a second electrode of the seventh transistor T7 is connected with the sixth node N6. A control electrode of the eight transistor T8 is connected with the first scanning signal terminal GateA, a first electrode of the eighth transistor T8 is connected with the fourth node N4, and a second electrode of the eighth transistor T8 is connected with the sixth node N6. One terminal of the third capacitor C3 is connected with the fourth node N4, and the other terminal of the third capacitor C3 is connected with the first voltage terminal VDD. A control electrode of the ninth transistor T9 is connected with the reset control signal terminal Reset, a first electrode of the ninth transistor T9 is connected with the initial voltage terminal Vinit, and a second electrode of the ninth transistor T9 is connected with the fourth node N4. A control electrode of the tenth transistor T10 is connected with the first scanning signal terminal GateA, a first electrode of the tenth transistor T10 is connected with the display data signal terminal DataI, and a second electrode of the tenth transistor T10 is connected with the fifth node N5. A control electrode of the eleventh transistor T11 is connected with the light emitting control signal terminal EM, a first electrode of the eleventh transistor T11 is connected with the first voltage terminal VDD, and a second electrode of the eleventh transistor T11 is connected with the fifth node N5. A control electrode of the twelfth transistor T12 is connected with the light emitting control signal terminal EM, a first electrode of the twelfth transistor T12 is connected with the sixth node N6, and a second electrode of the twelfth transistor T12 is connected with the first node N1.

FIG. 5 shows exemplary structures of the driving sub-circuit, the write sub-circuit, the compensation sub-circuit, the reset sub-circuit, and the light emitting control sub-circuit. Those skilled in the art easily understand that implementation modes of the driving sub-circuit, the write sub-circuit, the compensation sub-circuit, the reset sub-circuit, and the light emitting control sub-circuit are not limited thereto as long as functions thereof may be realized.

Figure 6:
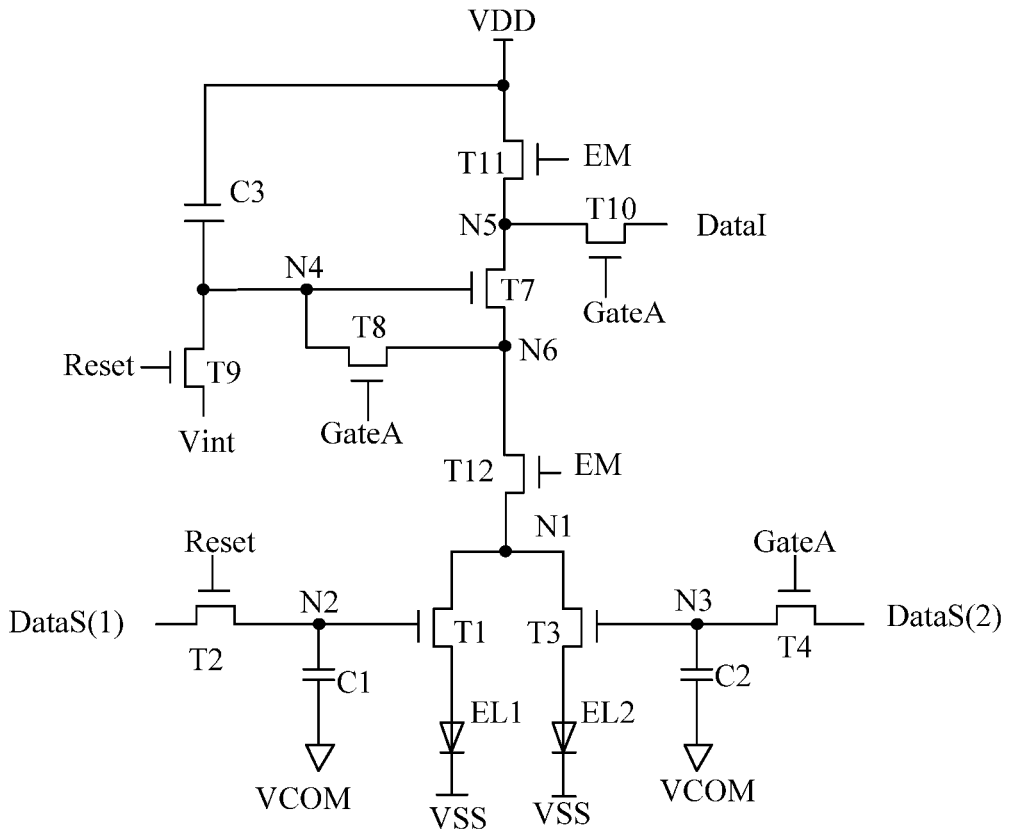
FIG. 6 is a first equivalent circuit diagram of a pixel circuit according to an embodiment of the present disclosure.

FIG. 6 is an equivalent circuit diagram of a pixel circuit according to an embodiment of the present disclosure. As shown in FIG. 6, in the pixel circuit provided in the embodiment of the present disclosure, the combined light emitting sub-circuit includes the first light emitting sub-circuit and the second light emitting sub-circuit, the current control sub-circuit includes the driving sub-circuit, the write sub-circuit, the compensation sub-circuit, the reset sub-circuit, and the light emitting control sub-circuit, the first light emitting sub-circuit includes the first transistor T1, the second transistor T2, and the first capacitor C1, the light emitting sub-circuit includes the third transistor T3, the fourth transistor T4, and the second capacitor C2, the driving sub-circuit includes the seventh transistor T7, the compensation sub-circuit includes the eighth transistor T8 and the third capacitor C3, the reset sub-circuit includes the ninth transistor T9, the write sub-circuit includes the tenth transistor T10, and the light emitting control sub-circuit includes the eleventh transistor T11 and the twelfth transistor T12.

Herein, the control electrode of the first transistor T1 is connected with the second node N2, the first electrode of the first transistor T1 is connected with the first node N1, the second electrode of the first transistor T1 is connected with an anode terminal of the first light emitting element ELL and a cathode terminal of the first light emitting element EL1 is connected with the second voltage terminal VSS. The control electrode of the second transistor T2 is connected with the reset control signal terminal Reset, the first electrode of the second transistor T2 is connected with the first light emitting data signal terminal DataS(1), and the second electrode of the second transistor T2 is connected with the second node N2. One terminal of the first capacitor C1 is connected with the second node N2, and the other terminal of the first capacitor C1 is connected with the common voltage terminal VCOM. The control electrode of the third transistor T3 is connected with the third node N3, the first electrode of the third transistor T3 is connected with the first node N1, the second electrode of the third transistor T3 is connected with an anode terminal of the second light emitting element EL2, and a cathode terminal of the second light emitting element EL2 is connected with the second voltage terminal VSS. The control electrode of the fourth transistor T4 is connected with the first scanning signal terminal GateA, the first electrode of the fourth transistor T4 is connected with the second light emitting data signal terminal DataS(2), and the second electrode of the fourth transistor T4 is connected with the third node N3. One terminal of the second capacitor C2 is connected with the third node N3, and the other terminal of the second capacitor C2 is connected with the common voltage terminal VCOM. The control electrode of the seventh transistor T7 is connected with the fourth node N4, the first electrode of the seventh transistor T7 is connected with the fifth node N5, and the second electrode of the seventh transistor T7 is connected with the sixth node N6. The control electrode of the eight transistor T8 is connected with the first scanning signal terminal GateA, the first electrode of the eighth transistor T8 is connected with the fourth node N4, and the second electrode of the eighth transistor T8 is connected with the sixth node N6. One terminal of the third capacitor C3 is connected with the fourth node N4, and the other terminal of the third capacitor C3 is connected with the first voltage terminal VDD. The control electrode of the ninth transistor T9 is connected with the reset control signal terminal Reset, the first electrode of the ninth transistor T9 is connected with the initial voltage terminal Vinit, and the second electrode of the ninth transistor T9 is connected with the fourth node N4. The control electrode of the tenth transistor T10 is connected with the first scanning signal terminal GateA, the first electrode of the tenth transistor T10 is connected with the display data signal terminal DataI, and the second electrode of the tenth transistor T10 is connected with the fifth node N5. The control electrode of the eleventh transistor T11 is connected with the light emitting control signal terminal EM, the first electrode of the eleventh transistor T11 is connected with the first voltage terminal VDD, and the second electrode of the eleventh transistor T11 is connected with the fifth node N5. The control electrode of the twelfth transistor T12 is connected with the light emitting control signal terminal EM, the first electrode of the twelfth transistor T12 is connected with the sixth node N6, and the second electrode of the twelfth transistor T12 is connected with the first node N1.

FIG. 6 shows exemplary structures of the combined light emitting sub-circuit and the current control sub-circuit. Those skilled in the art easily understand that implementation modes of each above sub-circuit are not limited thereto as long as functions thereof may be realized.

In the present embodiment, the light emitting element EL (including the first light emitting element EL1 to the Nth light emitting element ELN) may be a Micro LED, or may be another type of LED such as a Mini LED and an Organic Light Emitting Diode (OLED). In practical applications, the structure of the light emitting element EL may be designed and determined according to a practical application environment, and is not limited herein. Descriptions will be made below taking the condition that the light emitting element EL is a Micro LED as an example.

In the present embodiment, all the first transistor T1 to the fourth transistor T4 and the seventh transistor T7 to the twelfth transistor T12 may be N-type thin-film transistors or P-type thin-film transistors. All the transistors use the same type of thin-film transistors, so that a process flow may be unified, process procedures may be reduced, and the yield of the product is helped to be improved. In addition, considering that a drain current of a low-temperature polysilicon thin-film transistor is relatively low, all the transistors in the embodiment of the present disclosure may be low-temperature polysilicon thin-film transistors. The thin-film transistor may select a thin-film transistor of a bottom-gate structure or a thin-film transistor of a top-gate structure as long as a switch function may be realized.

In the embodiment of the present disclosure, the first capacitor C1 to the third capacitor C3 may be liquid crystal capacitors formed by pixel electrodes and common electrodes, or may be equivalent capacitors that are formed by liquid crystal capacitors formed by pixel electrodes and common electrodes and storage capacitors. No limits are made thereto in the present disclosure.

Figure 7:
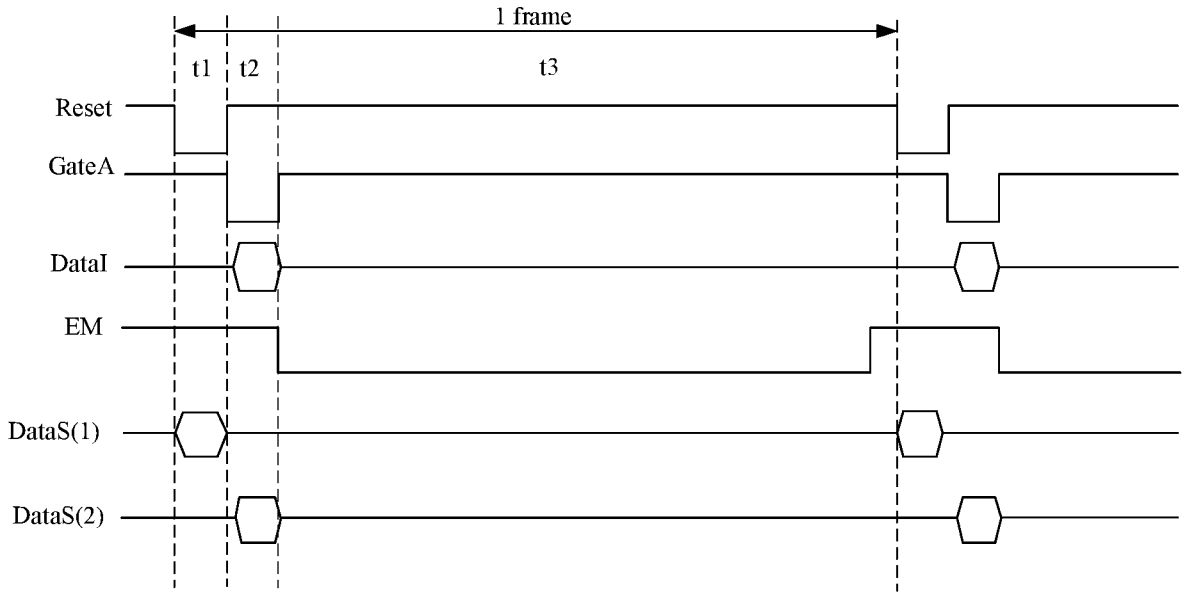
FIG. 7 is a working sequence diagram of the pixel circuit shown in FIG. 6 in a scanning period.

FIG. 7 is a working sequence diagram of the pixel circuit of the present embodiment. At the same time when the current control sub-circuit completes threshold voltage compensation, the combined light emitting sub-circuit transmits the light emitting data signals DataS(1) and DataS(2) for the first light emitting element EL1 and the second light emitting element EL2 to the first capacitor C1 and the second capacitor C2 by sequential control to complete combined light emitting of the first light emitting element EL1 and the second light emitting element EL2 within a time. Herein, signal values of the first light emitting data signal DataS(1) and the second light emitting data signal DataS(2) may be high levels or low levels, and the first transistor T1 and the third transistor T3 are controlled to be turned on and off through the first light emitting data signal DataS(1) and the second light emitting data signal DataS(2). Taking a working process of a first-stage pixel circuit as an example, the technical solution of the embodiment of the present disclosure will be described below through the working process of the pixel circuit.

A working process of a pixel circuit in a period of a frame will be described below in combination with the pixel circuit shown in FIG. 6 and the working sequence diagram shown in FIG. 7 taking the condition that all the first transistor T1 to the fourth transistor T4 and the seventh transistor T7 to the twelfth transistor T12 in the pixel circuit provided in the embodiment of the present disclosure are P-type thin-film transistors as an example. As shown in FIG. 6, the pixel circuit provided in the embodiment of the present disclosure includes 10 transistor units (T1 to T4, and T7 to T12), three capacitor units (C1 to C3), and three voltage terminals (VDD, VSS, and VCOM). Herein, the first voltage terminal VDD keeps providing a high-level signal, the second voltage terminal VSS keeps providing a low-level signal, and the common voltage terminal VCOM is grounded. The working process includes the following operations.

In a first stage t1, i.e., a reset stage, the reset control signal terminal Reset is pulled down, the ninth transistor T9 is turned on, and a gate of the seventh transistor T7 and one terminal of the third capacitor C3 (i.e., the fourth node N4) are reset to an initial voltage of the initial voltage terminal Vinit. Meanwhile, the second transistor T2 is turned on, and the first light emitting data signal of the first light emitting data signal terminal DataS(1) is transmitted to one terminal of the first capacitor C1 and a gate of the first transistor T1 to control turning-on/off of the first transistor T1.

In a second stage t2, i.e., a threshold voltage compensation and display data reading stage, a voltage of the first scanning signal terminal GateA is pulled down, the tenth transistor T10, the seventh transistor T7, and the eighth transistor T8 are turned on, the display data signal of the display data signal terminal DataI is input, and the display data signal and a threshold voltage (VdataI+Vth) are stored in the third capacitor C3. Meanwhile, the fourth transistor T4 is turned on, and the second light emitting data signal of the second light emitting data signal terminal DataS(2) is transmitted to the second capacitor C2 and a gate of the third transistor T3 to control turning-on/off of the third transistor T3.

In a third stage t3, i.e., a light emitting stage, the light emitting control signal terminal EM provides a low level, the eleventh transistor T11 and the twelfth transistor T12 are in an on state, and working states of the first light emitting elements EL1 and EL2 are determined according to on/off states of the first transistor T1 and the third transistor T3. For example, when the first light emitting data signal terminal DataS(1) is a low level, the first transistor T1 is turned on, and the first light emitting element EL1 works.

According to a display requirement, when a certain sub-pixel displays a low-grayscale picture, the first light emitting data signal terminal DataS(1) is a low level, and the second light emitting data signal terminal DataS(2) is a high level. In such case, the small-area Micro LED chip EL1 works, and the large-area Micro LED chip EL2 is turned off. When a certain sub-pixel displays a low-grayscale picture, the first light emitting data signal terminal DataS(1) is a low level, and the second light emitting data signal terminal DataS(2) is a low level. In such case, both the Micro LED chips EL1 and EL2 work.

In the abovementioned embodiment, light emitting elements with different areas are selected to implement combined light emitting to improve a grayscale display effect. Based on the abovementioned embodiment, two sets of independent scanning signals GOA, i.e., GateA and GateB (herein, GateB includes GateB(1) and GateB(2)), are introduced in the present embodiment, so that, during displaying of a frame, chips with different areas may be selected and combined for work, or different light emitting time periods of the chips may be selected.

In the present embodiment, the current control sub-circuit is further configured to control a duration of the generated driving current according to the light emitting control signal; and the combined light emitting sub-circuit is further configured to control light emitting durations of the first light emitting element EL1 to the Nth light emitting element ELN according to the duration of the generated driving current.

According to the pixel circuit provided in the embodiment of the present disclosure, the combined light emitting sub-circuit drives one or more of the first light emitting element EL1 to the Nth light emitting element ELN to emit light and control the light emitting durations thereof according to the duration of the generated driving current and the received first light emitting data signal to Nth light emitting data signal to implement combined light emitting of light emitting element chips with different areas and different light emitting durations, so that the display effects of the display device under high and low grayscales are further improved.

Descriptions are made in the embodiment of the present disclosure still taking N=2 as an example, namely the pixel circuit includes two light emitting elements. Light emitting areas of the two light emitting elements may be the same, or may be different. Exemplarily, the light emitting area of the first light emitting element EL1 may be smaller than the light emitting area of the second light emitting element EL2, to achieve a combined light emitting effect of different areas. The structure of the pixel circuit provided in the present embodiment is also applied to the condition that N is another value. When N is 3 or greater than 3, a light emitting sub-circuit where an ith light emitting element is located is connected with an (i+1)th scanning signal terminal GateB(i) and an ith light emitting data signal terminal DataS(i), i being a natural number from 1 to N.

Figure 8:
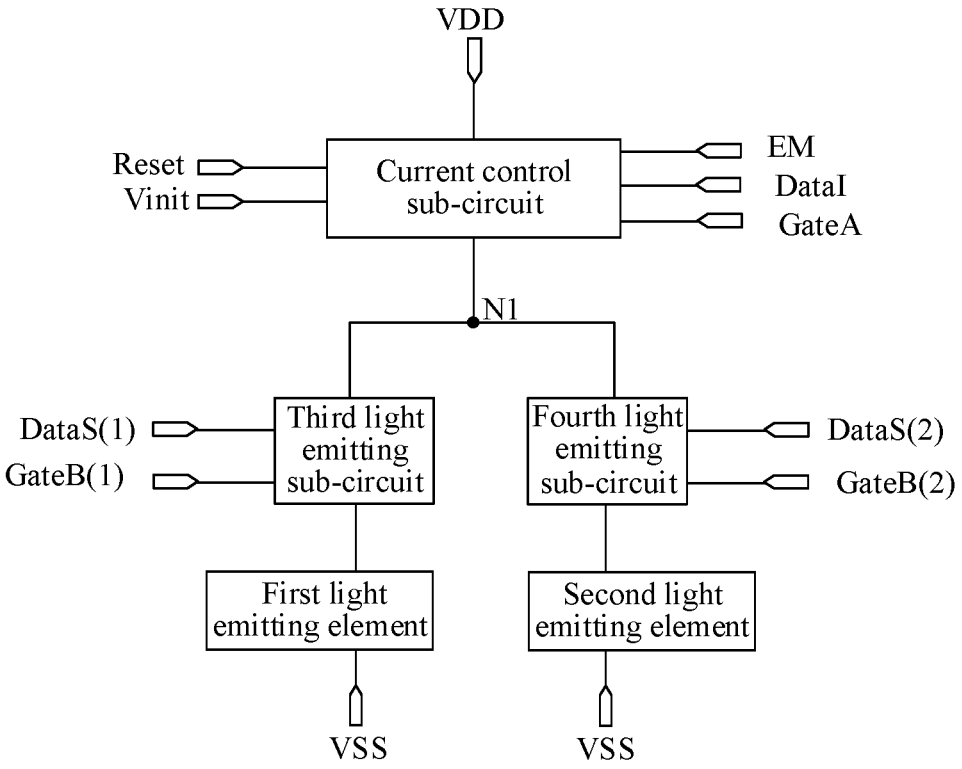
FIG. 8 is a third structural schematic diagram of a pixel circuit according to an embodiment of the present disclosure.

FIG. 8 is another structural schematic diagram of a pixel circuit according to an embodiment of the present disclosure. As shown in FIG. 8, the combined light emitting sub-circuit includes a third light emitting sub-circuit and a fourth light emitting sub-circuit, and the driving current is divided into the first driving current configured to drive the first light emitting element EL1 and the second driving current configured to drive the second light emitting element EL2.

Herein, the third light emitting sub-circuit is connected with the first node N1, a second scanning signal terminal GateB(1), the first light emitting data signal terminal DataS (1), and the first light emitting element EL1 respectively, and is configured to receive the first driving current, and under the control of a second scanning signal of the second scanning signal terminal GateB(1) and the first light emitting data signal of the first light emitting data signal terminal DataS(1), drive the first light emitting element EL1 to emit light and control a light emitting duration of the first light emitting element EL1 according to a duration of the first driving current, or control the first light emitting element EL1 not to emit light.

The fourth light emitting sub-circuit is connected with the first node N1, a third scanning signal terminal GateB(2), the second light emitting data signal terminal DataS(2), and the second light emitting element EL2 respectively, and is configured to receive the second driving current, and under the control of a third scanning signal of the third scanning signal terminal GateB(2) and the second light emitting data signal of the second light emitting data signal terminal DataS(2), drive the second light emitting element EL2 to emit light and control a light emitting duration of the second light emitting element EL2 according to a duration of the second driving current, or control the second light emitting element EL2 not to emit light.

In some exemplary embodiments, when only one of the first light emitting element EL1 and the second light emitting element EL2 emits light, the driving current of the sub-circuit corresponding to the light emitting element that does not emit light is zero. For example, when the first light emitting element EL1 emits light, and the second light emitting element EL2 does not emit light, the current value of the second driving current is zero, and the current value of the first driving current is equal to the current value of the driving current.

Figure 9:
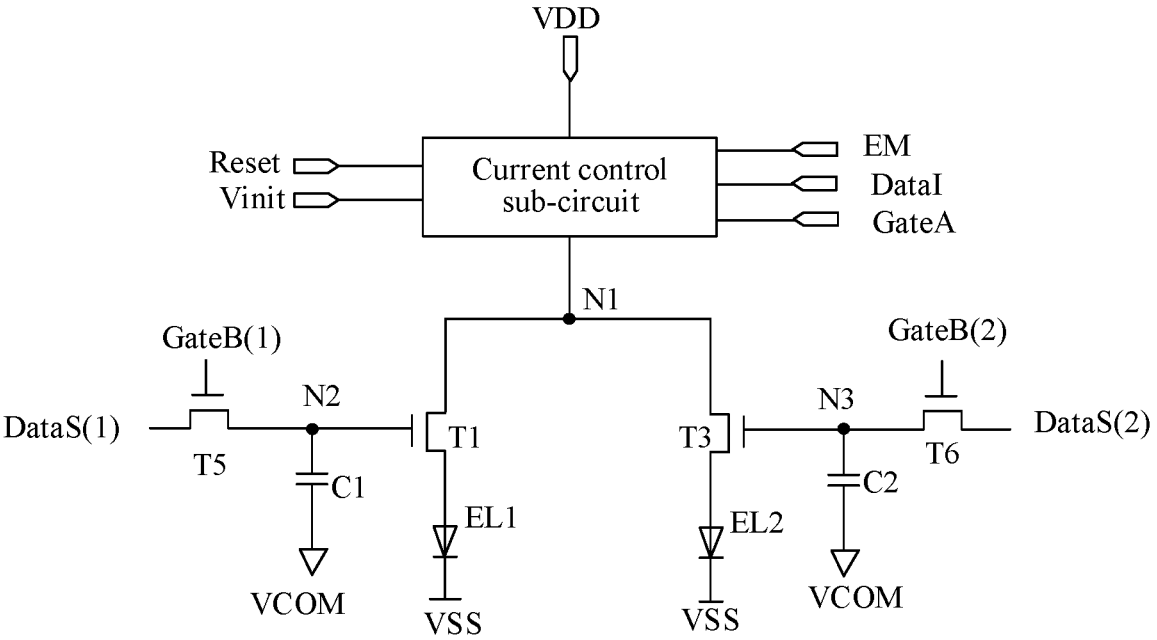
FIG. 9 is a second equivalent circuit diagram of a combined light emitting sub-circuit according to an embodiment of the present disclosure.

In some exemplary embodiments, as shown in FIG. 9, the third light emitting sub-circuit provided in the embodiment of the present disclosure includes the first transistor T1, a fifth transistor T5, and the first capacitor C1, and the fourth light emitting sub-circuit includes the third transistor T3, a sixth transistor T6, and the second capacitor C2.

Herein, the control electrode of the first transistor T1 is connected with the second node N2, the first electrode of the first transistor T1 is connected with the first node N1, the second electrode of the first transistor T1 is connected with the anode terminal of the first light emitting element EL1, and the cathode terminal of the first light emitting element EL1 is connected with the second voltage terminal VSS. A control electrode of the fifth transistor T5 is connected with the second scanning signal terminal GateB(1), a first electrode of the fifth transistor T5 is connected with the first light emitting data signal terminal DataS(1), and a second electrode of the fifth transistor T5 is connected with the second node N2. One terminal of the first capacitor C1 is connected with the second node N2, and the other terminal of the first capacitor C1 is connected with a common voltage terminal VCOM. The control electrode of the third transistor T3 is connected with the third node N3, the first electrode of the third transistor T3 is connected with the first node N1, the second electrode of the third transistor T3 is connected with the anode terminal of the second light emitting element EL2, and the cathode terminal of the second light emitting element EL2 is connected with the second voltage terminal VSS. A control electrode of the sixth transistor T6 is connected with the third scanning signal terminal GateB(2), a first electrode of the sixth transistor T6 is connected with the second light emitting data signal terminal DataS(2), and a second electrode of the sixth transistor T6 is connected with the third node N3. One terminal of the second capacitor C2 is connected with the third node N3, and the other terminal of the second capacitor C2 is connected with the common voltage terminal VCOM.

FIG. 9 shows exemplary structures of the third light emitting sub-circuit and the fourth light emitting sub-circuit. Those skilled in the art easily understand that implementation modes of the third light emitting sub-circuit and the fourth light emitting sub-circuit are not limited thereto as long as functions thereof may be realized.

The current control sub-circuit of the present embodiment may adopt the same structure as the current control sub-circuit of the abovementioned embodiment, and will not be elaborated herein.

Figure 10:
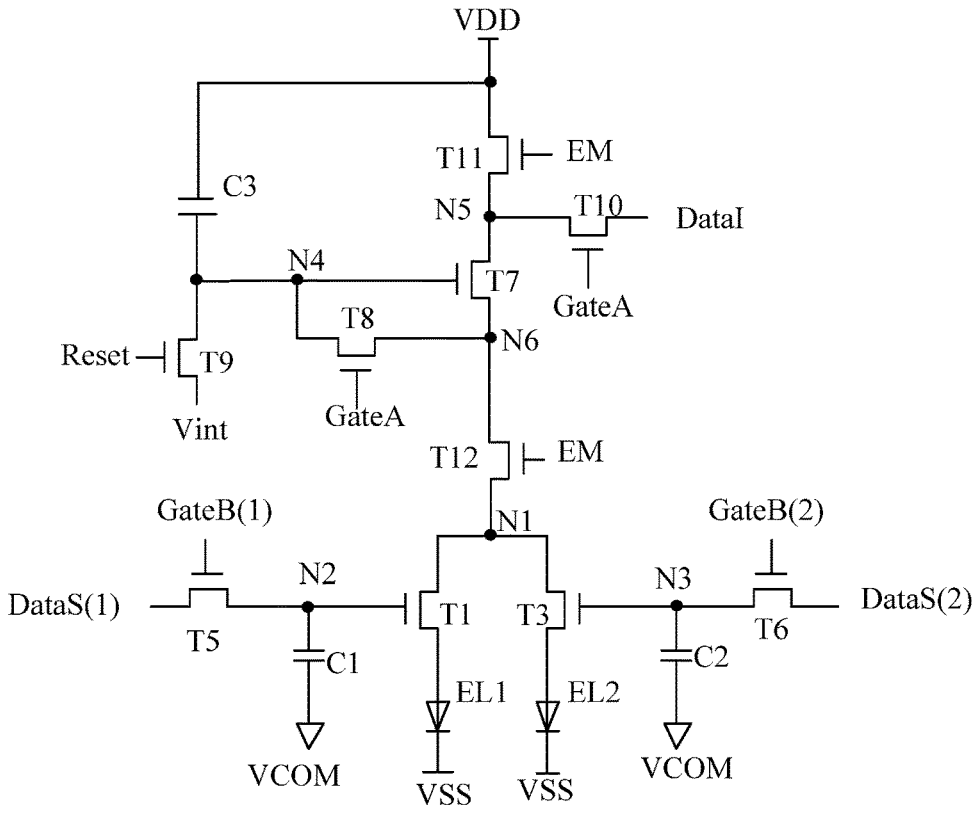
FIG. 10 is a second equivalent circuit diagram of a pixel circuit according to an embodiment of the present disclosure.

FIG. 10 is another equivalent circuit diagram of a pixel circuit according to an embodiment of the present disclosure. As shown in FIG. 10, in the pixel circuit provided in the embodiment of the present disclosure, the combined light emitting sub-circuit includes the first light emitting sub-circuit and the second light emitting sub-circuit, the current control sub-circuit includes the driving sub-circuit, the write sub-circuit, the compensation sub-circuit, the reset sub-circuit, and the light emitting control sub-circuit, the first light emitting sub-circuit includes the first transistor T1, the fifth transistor T5, and the first capacitor C1, the light emitting sub-circuit includes the third transistor T3, the sixth transistor T6, and the second capacitor C2, the driving sub-circuit includes the seventh transistor T7, the compensation sub-circuit includes the eighth transistor T8 and the third capacitor C3, the reset sub-circuit includes the ninth transistor T9, the write sub-circuit includes the tenth transistor T10, and the light emitting control sub-circuit includes the eleventh transistor T11 and the twelfth transistor T12.

Herein, the control electrode of the first transistor T1 is connected with the second node N2, the first electrode of the first transistor T1 is connected with the first node N1, the second electrode of the first transistor T1 is connected with the anode terminal of the first light emitting element ELL and the cathode terminal of the first light emitting element EL1 is connected with the second voltage terminal VSS. The control electrode of the fifth transistor T5 is connected with the second scanning signal terminal GateB(1), the first electrode of the fifth transistor T5 is connected with the first light emitting data signal terminal DataS(1), and the second electrode of the fifth transistor T5 is connected with the second node N2. One terminal of the first capacitor C1 is connected with the second node N2, and the other terminal of the first capacitor C1 is connected with the common voltage terminal VCOM. The control electrode of the third transistor T3 is connected with the third node N3, the first electrode of the third transistor T3 is connected with the first node N1, the second electrode of the third transistor T3 is connected with the anode terminal of the second light emitting element EL2, and the cathode terminal of the second light emitting element EL2 is connected with the second voltage terminal VSS. The control electrode of the sixth transistor T6 is connected with the third scanning signal terminal GateB(2), the first electrode of the sixth transistor T6 is connected with the second light emitting data signal terminal DataS(2), and the second electrode of the sixth transistor T6 is connected with the third node N3. One terminal of the second capacitor C2 is connected with the third node N3, and the other terminal of the second capacitor C2 is connected with the common voltage terminal VCOM. The control electrode of the seventh transistor T7 is connected with the fourth node N4, the first electrode of the seventh transistor T7 is connected with the fifth node N5, and the second electrode of the seventh transistor T7 is connected with the sixth node N6. The control electrode of the eight transistor T8 is connected with the first scanning signal terminal GateA, the first electrode of the eighth transistor T8 is connected with the fourth node N4, and the second electrode of the eighth transistor T8 is connected with the sixth node N6. One terminal of the third capacitor C3 is connected with the fourth node N4, and the other terminal of the third capacitor C3 is connected with the first voltage terminal VDD. The control electrode of the ninth transistor T9 is connected with the reset control signal terminal Reset, the first electrode of the ninth transistor T9 is connected with the initial voltage terminal Vinit, and the second electrode of the ninth transistor T9 is connected with the fourth node N4. The control electrode of the tenth transistor T10 is connected with the first scanning signal terminal GateA, the first electrode of the tenth transistor T10 is connected with the display data signal terminal DataI, and the second electrode of the tenth transistor T10 is connected with the fifth node N5. The control electrode of the eleventh transistor T11 is connected with the light emitting control signal terminal EM, the first electrode of the eleventh transistor T11 is connected with the first voltage terminal VDD, and the second electrode of the eleventh transistor T11 is connected with the fifth node N5. The control electrode of the twelfth transistor T12 is connected with the light emitting control signal terminal EM, the first electrode of the twelfth transistor T12 is connected with the sixth node N6, and the second electrode of the twelfth transistor T12 is connected with the first node N1.

FIG. 10 shows exemplary structures of the combined light emitting sub-circuit and the current control sub-circuit. Those skilled in the art easily understand that implementation modes of each above sub-circuit are not limited thereto as long as functions thereof may be realized.

In the present embodiment, the light emitting element EL (including the first light emitting element EL1 to the Nth light emitting element ELN) may be a Micro LED, or may be another type of LED such as a Mini LED and an OLED. In practical applications, the structure of the light emitting element EL may be designed and determined according to a practical application environment, and is not limited herein. Descriptions will be made below taking the condition that the light emitting element EL is a Micro LED as an example.

In the present embodiment, all the first transistor T1, the third transistor T3, and the fifth transistor T5 to the twelfth transistor T12 may be N-type thin-film transistors or P-type thin-film transistors, so that the process flow may be unified, the process procedures may be reduced, and the yield of the product is helped to be improved. In addition, considering that a drain current of a low-temperature polysilicon thin-film transistor is relatively low, all the transistors in the embodiment of the present disclosure may be low-temperature polysilicon thin-film transistors. The thin-film transistor may select a thin-film transistor of a bottom-gate structure or a thin-film transistor of a top-gate structure as long as a switch function may be realized.

In the present embodiment, the first capacitor C1 to the third capacitor C3 may be liquid crystal capacitors formed by pixel electrodes and common electrodes, or may be equivalent capacitors that are formed by liquid crystal capacitors formed by pixel electrodes and common electrodes and storage capacitors. No limits are made thereto in the present disclosure.

Taking a working process of a first-stage pixel circuit as an example, the technical solution of the embodiment of the present disclosure will be described below through the working process of the pixel circuit.

Figure 11:
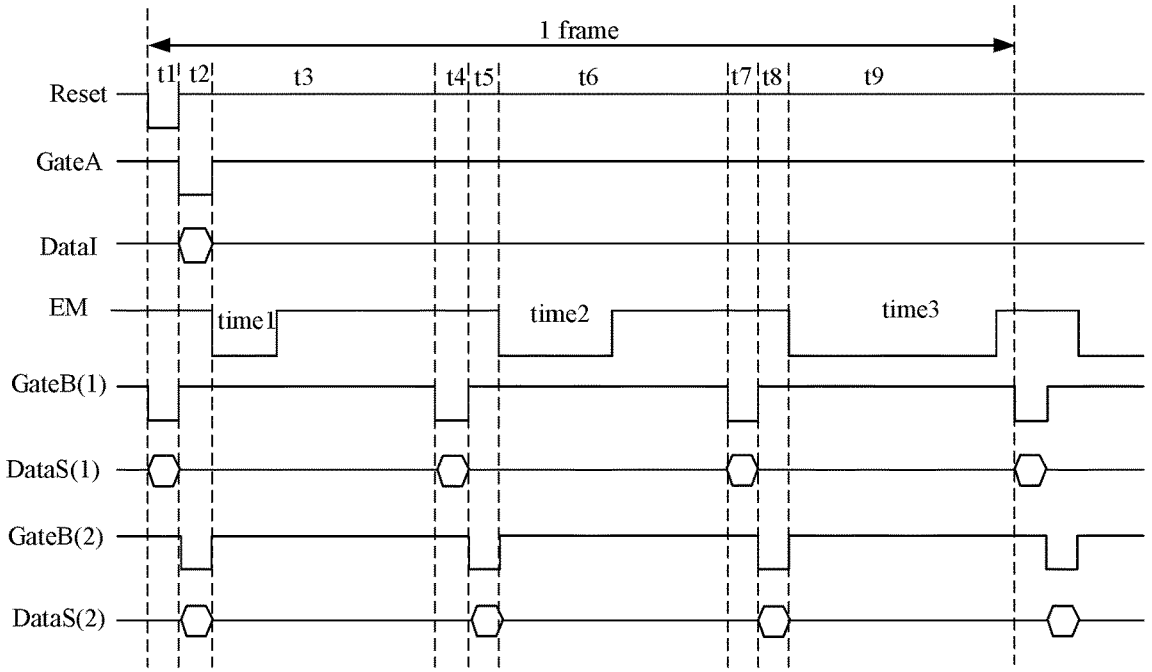
FIG. 11 is a working sequence diagram of the pixel circuit shown in FIG. 10 in a scanning period.

A working process of a pixel circuit in a period of a frame will be described below in combination with the pixel circuit shown in FIG. 10 and the working sequence diagram shown in FIG. 11 taking the condition that all the first transistor T1, the third transistor T3, and the fifth transistor T5 to the twelfth transistor T12 in the pixel circuit provided in the embodiment of the present disclosure are P-type thin-film transistors as an example. As shown in FIG. 10, the pixel circuit provided in the embodiment of the present disclosure includes 10 transistor units (T1, T3, and T5 to T12), three capacitor units (C1 to C3), and three voltage terminals (VDD, VSS, and VCOM). Herein, the first voltage terminal VDD keeps providing a high-level signal, the second voltage terminal VSS keeps providing a low-level signal, and the common voltage terminal VCOM is grounded. The working process includes the following operations.

In a first stage t1, i.e., a reset stage, the reset control signal terminal Reset is pulled down, the ninth transistor T9 is turned on, and a gate of the seventh transistor T7 and one terminal of the third capacitor C3 (i.e., the fourth node N4) are reset to an initial voltage of the initial voltage terminal Vinit. Meanwhile, the second scanning signal terminal GateB(1) is a low level, the second transistor T2 is turned on, and the first light emitting data signal of the first light emitting data signal terminal DataS(1) is transmitted to one terminal of the first capacitor C1 and the gate of the first transistor T1 to control turning-on/off of the first transistor T1.

In a second stage t2, i.e., a threshold voltage compensation and display data reading stage, a voltage of the first scanning signal terminal GateA is pulled down, the tenth transistor T10, the seventh transistor T7, and the eighth transistor T8 are turned on, the display data signal of the display data signal terminal DataI is input, and the display data signal and a threshold voltage (VdataI+Vth) are stored in the third capacitor C3. Meanwhile, the third scanning signal terminal GateB(2) is a low level, the fourth transistor T4 is turned on, and the second light emitting data signal of the second light emitting data signal terminal DataS(2) is transmitted to the second capacitor C2 and the gate of the third transistor T3 to control turning-on/off of the third transistor T3.

In a third stage t3, i.e., a first light emitting sub-stage, the light emitting control signal terminal EM provides a low level in time1, the light emitting control signal terminal EM is a high level in other time (t3−time1). When the light emitting control signal terminal EM is a low level in time1, the eleventh transistor T11 and the twelfth transistor T12 are in an on state, and light emitting states of the first light emitting elements EL1 and EL2 are determined according to on/off states of the first transistor T1 and the third transistor T3. For example, when the first light emitting data signal terminal DataS(1) is a low level, the first transistor T1 is turned on, the first light emitting element EL1 emits light, and the light emitting duration is time1.

In a fourth stage t4, i.e., a first light emitting data input stage, the second scanning signal terminal GateB(1) is a low level, the second transistor T2 is turned on, and the first light emitting data signal of the first light emitting data signal terminal DataS(1) is transmitted to one terminal of the first capacitor C1 and the gate of the first transistor T1 to control turning-on/off of the first transistor T1.

In a fifth stage t5, i.e., a second light emitting data input stage, the third scanning signal terminal GateB(2) is a low level, the fourth transistor T4 is turned on, and the second light emitting data signal of the second light emitting data signal terminal DataS(2) is transmitted to the second capacitor C2 and the gate of the third transistor T3 to control turning-on/off of the third transistor T3.

In a sixth stage t6, i.e., a second light emitting sub-stage, the light emitting control signal terminal EM provides a low level in time2, the light emitting control signal terminal EM is a high level in other time (t6−time2). When the light emitting control signal terminal EM is a low level in time2, the eleventh transistor T11 and the twelfth transistor T12 are in an on state, and the light emitting states of the first light emitting elements EL1 and EL2 are determined according to the on/off states of the first transistor T1 and the third transistor T3. For example, when the second light emitting data signal terminal DataS(2) is a low level, the third transistor T3 is turned on, the second light emitting element EL2 emits light, and the light emitting duration is time2.

A working process in a seventh stage t7 is the same as the fourth stage t4, a working process in an eighth stage t8 is the same as the fifth stage t5, and a working process in a ninth stage t9 is the same as the sixth stage t6.

From the above steps, the small-area first light emitting element EL1 may be adopted to emit light for time1 in time of a frame during low-grayscale displaying of a display sub-pixel, and under a high grayscale, the first light emitting element EL1 and the second light emitting element EL2 are adopted to simultaneously emit light for (time1+time2+time3).

An embodiment of the present disclosure also provides a display device, which includes the pixel circuit as described in any abovementioned embodiment. The display device of the embodiment of the present disclosure may be any product or component with a display function, such as a mobile phone, a tablet computer, a television, a display, a notebook computer, a digital photo frame, and a navigator.

Figure 12:
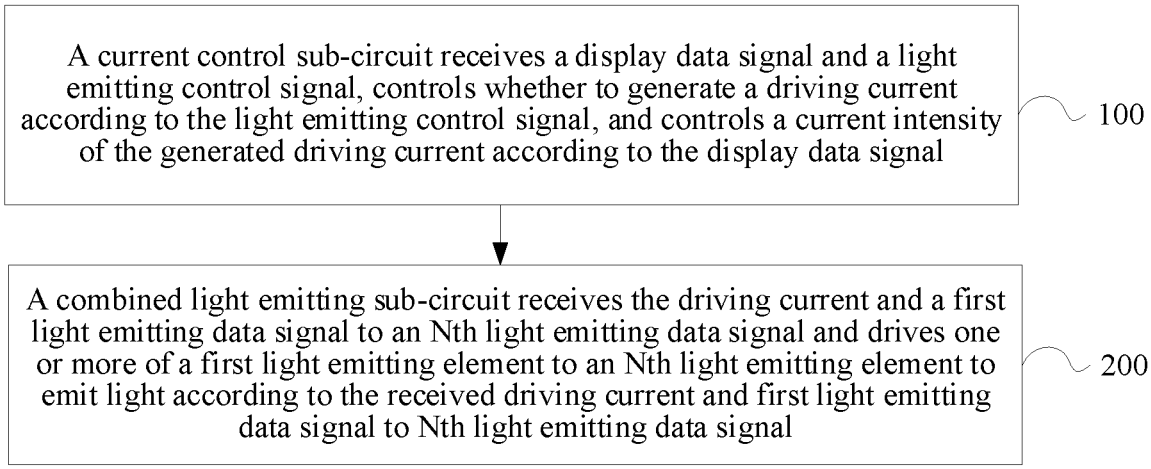
FIG. 12 is a first flowchart of a driving method for a pixel circuit according to an embodiment of the present disclosure.

An embodiment of the present disclosure also provides a driving method for a pixel circuit, which is used to drive the pixel circuit that controls whether to generate a driving current according to a light emitting control signal in the abovementioned embodiment. The pixel circuit has multiple scanning periods. In a scanning period, as shown in FIG. 12, the driving method includes Step 100 to Step 200.

Herein, Step 100 includes that: a current control sub-circuit receives a display data signal and a light emitting control signal, controls whether to generate a driving current according to the light emitting control signal, and controls a current intensity of the generated driving current according to the display data signal.

In the present embodiment, Step 100 includes the following operations.

A reset sub-circuit discharges a third capacitor under the control of a reset signal.

A write sub-circuit and a compensation sub-circuit store the display data signal and a threshold voltage in the third capacitor under the control of a first scanning signal.

A light emitting control sub-circuit is turned on under the control of the light emitting control signal, and the driving current generated by a driving sub-circuit is provided for a combined light emitting sub-circuit through the light emitting control sub-circuit.

Step 200 includes that: the combined light emitting sub-circuit receives the driving current and a first light emitting data signal to an Nth light emitting data signal and drives one or more of a first light emitting element to an Nth light emitting element to emit light according to the received driving current and first light emitting data signal to Nth light emitting data signal.

In the present embodiment, the combined light emitting sub-circuit includes a first light emitting sub-circuit and a second light emitting sub-circuit, and the driving current is divided into a first driving current configured to drive the first light emitting element and a second driving current configured to drive a second light emitting element.

The first light emitting sub-circuit receives the first driving current and a first light emitting data signal, and under the control of the reset signal and the first light emitting data signal, drives the first light emitting element to emit light or controls the first light emitting element not to emit light.

The second light emitting sub-circuit receives the second driving current and a second light emitting data signal, and under the control of the first scanning signal and the second light emitting data signal, drives the second light emitting element to emit light or controls the second light emitting element not to emit light.

Figure 13:
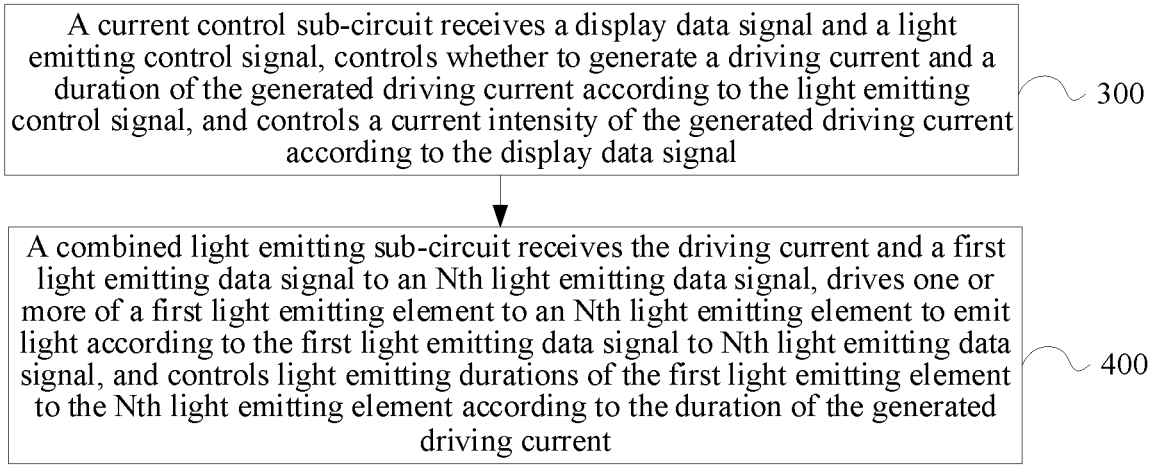
FIG. 13 is a second flowchart of a driving method for a pixel circuit according to an embodiment of the present disclosure.

An embodiment of the present disclosure also provides a driving method for a pixel circuit, which is used to drive the pixel circuit that controls whether to generate a driving current and a duration of the generated driving current according to a light emitting control signal in the abovementioned embodiment. The pixel circuit has multiple scanning periods. In a scanning period, as shown in FIG. 13, the driving method includes Step 300 to Step 400.

Herein, Step 300 includes that: a current control sub-circuit receives a display data signal and a light emitting control signal, controls whether to generate a driving current and a duration of the generated driving current according to the light emitting control signal, and controls a current intensity of the generated driving current according to the display data signal.

In the present embodiment, Step 300 includes the following operations.

A reset sub-circuit discharges a third capacitor under the control of a reset signal.

A write sub-circuit and a compensation sub-circuit store the display data signal and a threshold voltage in the third capacitor under the control of a first scanning signal.

A light emitting control sub-circuit is turned on under the control of the light emitting control signal, the driving current generated by a driving sub-circuit is provided for a combined light emitting sub-circuit through the light emitting control sub-circuit, and the light emitting control sub-circuit controls a passage duration of the driving current.

Step 400 includes that: the combined light emitting sub-circuit receives the driving current and a first light emitting data signal to an Nth light emitting data signal, drives one or more of a first light emitting element to an Nth light emitting element to emit light according to the received driving current and first light emitting data signal to Nth light emitting data signal, and controls light emitting durations of the first light emitting element to the Nth light emitting element according to the duration of the generated driving current.

In the present embodiment, the combined light emitting sub-circuit includes a first light emitting sub-circuit and a second light emitting sub-circuit, and the driving current is divided into a first driving current configured to drive the first light emitting element and a second driving current configured to drive a second light emitting element. Step 400 includes the following operations.

The third light emitting sub-circuit receives the first driving current, and under the control of a second scanning signal terminal and a first light emitting data signal terminal, drives the first light emitting element to emit light and controls the light emitting duration of the first light emitting element according to a duration of the first driving current, or controls the first light emitting element not to emit light.

The fourth light emitting sub-circuit receives the second driving current, and under the control of a third scanning signal terminal and a second light emitting data signal terminal, drives a second light emitting element to emit light and controls a light emitting duration of the second light emitting element according to a duration of the second driving current, or controls the second light emitting element not to emit light.

According to the pixel circuit, driving method for the same, and display device provided in the embodiments of the present disclosure, the combined light emitting sub-circuit drives one or more of the first light emitting element to the Nth light emitting element to emit light according to the received driving current and first light emitting data signal to Nth light emitting data signal to implement combined light emitting of light emitting element chips with different areas, so that the display effects of the display device under high and low grayscales are improved.

The following points need to be noted.

The drawings of the embodiments of the present disclosure only involve the structures involved in the embodiments of the present disclosure, and the other structures may refer to conventional designs.

The embodiments in the present disclosure, i.e., the features in the embodiments, can be combined without conflicts to obtain new embodiments.

Although the implementation modes of the present disclosure are disclosed above, the contents are only implementation modes adopted to conveniently understand the present disclosure and not intended to limit the present disclosure. Those skilled in the art may make any modifications and variations to implementation forms and details without departing from the spirit and scope disclosed by the present disclosure. However, the patent protection scope of the present disclosure should also be subject to the scope defined by the appended claims. Although the implementation modes of the present disclosure are disclosed above, the contents are only implementation modes adopted to conveniently understand the present disclosure and not intended to limit the present disclosure. Those skilled in the art may make any modifications and variations to implementation forms and details without departing from the spirit and scope disclosed by the present disclosure. However, the patent protection scope of the present disclosure should also be subject to the scope defined by the appended claims.

What we claim is:

1. A pixel circuit, comprising a current control sub-circuit, a combined light emitting sub-circuit, and a first light emitting element to an Nth light emitting element, N being a natural number greater than 1, wherein:

the current control sub-circuit is configured to receive a display data signal and a light emitting control signal, control whether to generate a driving current according to the light emitting control signal, and control a current intensity of a generated driving current according to the display data signal;

the combined light emitting sub-circuit is configured to receive the driving current and a first light emitting data signal to an Nth light emitting data signal and drive one or more of the first light emitting element to the Nth light emitting element to emit light according to the received driving current and first light emitting data signal to Nth light emitting data signal, the combined light emitting sub-circuit comprises a first light emitting sub-circuit and a second light emitting sub-circuit, and the driving current is divided into a first driving current configured to drive the first light emitting element and a second driving current configured to drive the second light emitting element, the first light emitting sub-circuit is connected with a reset control signal terminal, a first light emitting data signal terminal, and the first light emitting element respectively, and is configured to receive the first driving current, and under the control of the reset control signal terminal and the first light emitting data signal terminal, drive the first light emitting element to emit light or control the first light emitting element not to emit light; and the second light emitting sub-circuit is connected with a first scanning signal terminal, a second light emitting data signal terminal, and the second light emitting element respectively, and is configured to receive the second driving current, and under the control of the first scanning signal terminal and the second light emitting data signal terminal, drive the second light emitting element to emit light or control the second light emitting element not to emit light.

2. The pixel circuit according to claim 1, wherein the first light emitting sub-circuit comprises a first transistor, a second transistor, and a first capacitor, wherein a control electrode of the first transistor is connected with a second node, a first electrode of the first transistor is connected with a first node, and a second electrode of the first transistor is connected with the first light emitting element;

a control electrode of the second transistor is connected with the reset control signal terminal, a first electrode of the second transistor is connected with the first light emitting data signal terminal, and a second electrode of the second transistor is connected with the second node; and one terminal of the first capacitor is connected with the second node, and the other terminal of the first capacitor is connected with a common voltage terminal.

3. The pixel circuit according to claim 1, wherein the second light emitting sub-circuit comprises a third transistor, a fourth transistor, and a second capacitor, wherein a control electrode of the third transistor is connected with a third node, a first electrode of the third transistor is connected with a first node, and a second electrode of the third transistor is connected with the second light emitting element;

a control electrode of the fourth transistor is connected with the first scanning signal terminal, a first electrode of the fourth transistor is connected with the second light emitting data signal terminal, and a second electrode of the fourth transistor is connected with the third node; and one terminal of the second capacitor is connected with the third node, and the other terminal of the second capacitor is connected with a common voltage terminal.

4. The pixel circuit according to claim 1, wherein the current control sub-circuit is further configured to control a duration of the generated driving current according to the light emitting control signal; and the combined light emitting sub-circuit is further configured to control light emitting durations of the first light emitting element to the Nth light emitting element according to the duration of the generated driving current.

5. The pixel circuit according to claim 4, wherein the combined light emitting sub-circuit comprises a third light emitting sub-circuit and a fourth light emitting sub-circuit, and the driving current is divided into a first driving current configured to drive the first light emitting element and a second driving current configured to drive the second light emitting element, wherein the third light emitting sub-circuit is connected with a second scanning signal terminal, the first light emitting data signal terminal, and the first light emitting element respectively, and is configured to receive the first driving current, and under the control of the second scanning signal terminal and the first light emitting data signal terminal, drive the first light emitting element to emit light and control a light emitting duration of the first light emitting element according to a duration of the first driving current, or control the first light emitting element not to emit light; and the fourth light emitting sub-circuit is connected with a third scanning signal terminal, the second light emitting data signal terminal, and the second light emitting element respectively, and is configured to receive the second driving current, and under the control of the third scanning signal terminal and the second light emitting data signal terminal, drive the second light emitting element to emit light and control a light emitting duration of the second light emitting element according to a duration of the second driving current, or control the second light emitting element not to emit light.

6. The pixel circuit according to claim 5, wherein the third light emitting sub-circuit comprises a first transistor, a fifth transistor, and a first capacitor, wherein a control electrode of the first transistor is connected with a second node, a first electrode of the first transistor is connected with a first node, and a second electrode of the first transistor is connected with the first light emitting element;

a control electrode of the fifth transistor is connected with the second scanning signal terminal, a first electrode of the fifth transistor is connected with the first light emitting data signal terminal, and a second electrode of the fifth transistor is connected with the second node; and one terminal of the first capacitor is connected with the second node, and the other terminal of the first capacitor is connected with a common voltage terminal.

7. The pixel circuit according to claim 5, wherein the fourth light emitting sub-circuit comprises a third transistor, a sixth transistor, and a second capacitor, wherein a control electrode of the third transistor is connected with a third node, a first electrode of the third transistor is connected with a first node, and a second electrode of the third transistor is connected with the second light emitting element;

a control electrode of the sixth transistor is connected with the third scanning signal terminal, a first electrode of the sixth transistor is connected with the second light emitting data signal terminal, and a second electrode of the sixth transistor is connected with the third node; and one terminal of the second capacitor is connected with the third node, and the other terminal of the second capacitor is connected with a common voltage terminal.

8. The pixel circuit according to claim 1, wherein the current control sub-circuit comprises a driving sub-circuit, a write sub-circuit, a compensation sub-circuit, a reset sub-circuit, and a light emitting control sub-circuit, wherein the driving sub-circuit is connected with a fourth node, a fifth node, and a sixth node respectively, and is configured to provide the driving current for the sixth node under the control of signals of the fourth node and the fifth node;

the write sub-circuit is connected with a first scanning signal terminal, the display data signal terminal, and the fifth node respectively, and is configured to write a signal of the display data signal terminal to the fifth node under the control of a signal of the first scanning signal terminal;

the compensation sub-circuit is connected with a first voltage terminal, the first scanning signal terminal, the fourth node, and the sixth node respectively, and is configured to compensate the fourth node under the control of the signal of the first scanning signal terminal and a signal of the first voltage terminal;

the reset sub-circuit is connected with a reset control signal terminal, an initial voltage terminal, and the fourth node respectively, and is configured to write a signal of the initial voltage terminal to the fourth node under the control of a signal of the reset control signal terminal; and the light emitting control sub-circuit is connected with the first voltage terminal, the light emitting control signal terminal, a first node, the fifth node, and the sixth node respectively, and is configured to provide the signal of the first voltage terminal for the fifth node under the control of a signal of the light emitting control signal terminal, and allow the driving current to flow between the sixth node and the first node.

9. The pixel circuit according to claim 8, wherein the driving sub-circuit comprises a seventh transistor, the compensation sub-circuit comprises an eighth transistor and a third capacitor, the reset sub-circuit comprises a ninth transistor, the write sub-circuit comprises a tenth transistor, and the light emitting control sub-circuit comprises an eleventh transistor and a twelfth transistor, wherein a control electrode of the seventh transistor is connected with the fourth node, a first electrode of the seventh transistor is connected with the fifth node, and a second electrode of the seventh transistor is connected with the sixth node;

a control electrode of the eight transistor is connected with the first scanning signal terminal, a first electrode of the eighth transistor is connected with the fourth node, and a second electrode of the eighth transistor is connected with the sixth node;

one terminal of the third capacitor is connected with the fourth node, and the other terminal of the third capacitor is connected with the first voltage terminal;

a control electrode of the ninth transistor is connected with the reset control signal terminal, a first electrode of the ninth transistor is connected with the initial voltage terminal, and a second electrode of the ninth transistor is connected with the fourth node;

a control electrode of the tenth transistor is connected with the first scanning signal terminal, a first electrode of the tenth transistor is connected with the display data signal terminal, and a second electrode of the tenth transistor is connected with the fifth node;

a control electrode of the eleventh transistor is connected with the light emitting control signal terminal, a first electrode of the eleventh transistor is connected with the first voltage terminal, and a second electrode of the eleventh transistor is connected with the fifth node; and a control electrode of the twelfth transistor is connected with the light emitting control signal terminal, a first electrode of the twelfth transistor is connected with the sixth node, and a second electrode of the twelfth transistor is connected with the first node.

10. The pixel circuit according to claim 1, wherein the first light emitting element to the Nth light emitting element are Micro Light Emitting Diodes (LEDs), Mini LEDs, or Organic LEDs (OLEDs).

11. A display device, comprising the pixel circuit according to claim 1.

12. A driving method for a pixel circuit, used to drive the pixel circuit according to claim 1, the pixel circuit having multiple scanning periods, and in a scanning period, the driving method comprising:

receiving, by a current control sub-circuit, a display data signal and a light emitting control signal, controlling whether to generate a driving current according to the light emitting control signal, and controlling a current intensity of a generated driving current according to the display data signal; and receiving, by a combined light emitting sub-circuit, the driving current and a first light emitting data signal to an Nth light emitting data signal, and driving one or more of a first light emitting element to an Nth light emitting element to emit light according to the received driving current and first light emitting data signal to Nth light emitting data signal.

13. The driving method for a pixel circuit according to claim 12, wherein receiving, by the current control sub-circuit, the display data signal and the light emitting control signal, controlling whether to generate the driving current according to the light emitting control signal, and controlling the current intensity of the generated driving current according to the display data signal comprises:

discharging, by a reset sub-circuit, a third capacitor under the control of a reset signal;

storing, by a write sub-circuit and a compensation sub-circuit, the display data signal and a threshold voltage in the third capacitor under the control of a first scanning signal; and turning on a light emitting control sub-circuit under the control of the light emitting control signal, and providing the driving current generated by a driving sub-circuit for the combined light emitting sub-circuit through the light emitting control sub-circuit.

14. The driving method for a pixel circuit according to claim 12, further comprising:

controlling, by the current control sub-circuit, a duration of the generated driving current according to the light emitting control signal; and controlling, by the combined light emitting sub-circuit, light emitting durations of the first light emitting element to the Nth light emitting element according to the duration of the generated driving current.

15. The driving method for a pixel circuit according to claim 14, wherein controlling by the current control sub-circuit, whether to generate the driving current and the duration of the generated driving current according to the light emitting control signal and controlling the current intensity of the generated driving current according to the display data signal comprises:

discharging, by a reset sub-circuit, a third capacitor under the control of a reset signal;

storing, by the write sub-circuit and the compensation sub-circuit, the display data signal and a threshold voltage in the third capacitor under the control of a first scanning signal; and turning on a light emitting control sub-circuit under the control of the light emitting control signal, providing the driving current generated by the driving sub-circuit for the combined light emitting sub-circuit through the light emitting control sub-circuit, and controlling, by the light emitting control sub-circuit, a passage duration of the driving current.

16. The pixel circuit according to claim 2, wherein the current control sub-circuit comprises a driving sub-circuit, a write sub-circuit, a compensation sub-circuit, a reset sub-circuit, and a light emitting control sub-circuit, wherein the driving sub-circuit is connected with a fourth node, a fifth node, and a sixth node respectively, and is configured to provide the driving current for the sixth node under the control of signals of the fourth node and the fifth node;

the write sub-circuit is connected with the first scanning signal terminal, the display data signal terminal, and the fifth node respectively, and is configured to write a signal of the display data signal terminal to the fifth node under the control of a signal of the first scanning signal terminal;

the compensation sub-circuit is connected with a first voltage terminal, the first scanning signal terminal, the fourth node, and the sixth node respectively, and is configured to compensate the fourth node under the control of the signal of the first scanning signal terminal and a signal of the first voltage terminal;

the reset sub-circuit is connected with the reset control signal terminal, an initial voltage terminal, and the fourth node respectively, and is configured to write a signal of the initial voltage terminal to the fourth node under the control of a signal of the reset control signal terminal; and the light emitting control sub-circuit is connected with the first voltage terminal, the light emitting control signal terminal, the first node, the fifth node, and the sixth node respectively, and is configured to provide the signal of the first voltage terminal for the fifth node under the control of a signal of the light emitting control signal terminal, and allow the driving current to flow between the sixth node and the first node.

17. The pixel circuit according to claim 3, wherein the current control sub-circuit comprises a driving sub-circuit, a write sub-circuit, a compensation sub-circuit, a reset sub-circuit, and a light emitting control sub-circuit, wherein the driving sub-circuit is connected with a fourth node, a fifth node, and a sixth node respectively, and is configured to provide the driving current for the sixth node under the control of signals of the fourth node and the fifth node;

the write sub-circuit is connected with the first scanning signal terminal, the display data signal terminal, and the fifth node respectively, and is configured to write a signal of the display data signal terminal to the fifth node under the control of a signal of the first scanning signal terminal;

the compensation sub-circuit is connected with a first voltage terminal, the first scanning signal terminal, the fourth node, and the sixth node respectively, and is configured to compensate the fourth node under the control of the signal of the first scanning signal terminal and a signal of the first voltage terminal;

the reset sub-circuit is connected with the reset control signal terminal, an initial voltage terminal, and the fourth node respectively, and is configured to write a signal of the initial voltage terminal to the fourth node under the control of a signal of the reset control signal terminal; and the light emitting control sub-circuit is connected with the first voltage terminal, the light emitting control signal terminal, the first node, the fifth node, and the sixth node respectively, and is configured to provide the signal of the first voltage terminal for the fifth node under the control of a signal of the light emitting control signal terminal, and allow the driving current to flow between the sixth node and the first node.

18. The pixel circuit according to claim 4, wherein the current control sub-circuit comprises a driving sub-circuit, a write sub-circuit, a compensation sub-circuit, a reset sub-circuit, and a light emitting control sub-circuit, wherein the driving sub-circuit is connected with a fourth node, a fifth node, and a sixth node respectively, and is configured to provide the driving current for the sixth node under the control of signals of the fourth node and the fifth node;

the write sub-circuit is connected with a first scanning signal terminal, the display data signal terminal, and the fifth node respectively, and is configured to write a signal of the display data signal terminal to the fifth node under the control of a signal of the first scanning signal terminal;

the compensation sub-circuit is connected with a first voltage terminal, the first scanning signal terminal, the fourth node, and the sixth node respectively, and is configured to compensate the fourth node under the control of the signal of the first scanning signal terminal and a signal of the first voltage terminal;

the reset sub-circuit is connected with a reset control signal terminal, an initial voltage terminal, and the fourth node respectively, and is configured to write a signal of the initial voltage terminal to the fourth node under the control of a signal of the reset control signal terminal; and the light emitting control sub-circuit is connected with the first voltage terminal, the light emitting control signal terminal, a first node, the fifth node, and the sixth node respectively, and is configured to provide the signal of the first voltage terminal for the fifth node under the control of a signal of the light emitting control signal terminal, and allow the driving current to flow between the sixth node and the first node.

* * * * *